United States Patent [19]

Hoffman et al.

[11] Patent Number: 4,560,453

[45] Date of Patent: Dec. 24, 1985

[54] EFFICIENT, SAFE METHOD FOR DECOPPERING COPPER REFINERY ELECTROLYTE

[75] Inventors: James E. Hoffman, Houston, Tex.; John S. Batzold, Paris, France

[73] Assignee: Exxon Research and Engineering Co., Florham Park, N.J.

[21] Appl. No.: 717,431

[22] Filed: Mar. 28, 1985

[51] Int. Cl.[4] ..... C25C 1/12

[52] U.S. Cl. ..... 204/106; 204/108

[58] Field of Search ..... 204/108, 106-107

[56] References Cited

U.S. PATENT DOCUMENTS 4,385,970 5/1983 Skopp et al. ..... 204/108

4,474,654 10/1984 Hyvärinen ..... 204/108

*Primary Examiner*—R. L. Andrews

*Attorney, Agent, or Firm*—Joseph J. Dvorak

[57] ABSTRACT

The present invention is directed toward a method for removing copper from solutions containing arsenic and antimony and in which the copper concentration in the solution is sufficiently low whereby arsine and stibine would normally be generated if the solution was subject to electrolysis. According to the practice of the present invention, copper is recovered from such solutions by contacting said solutions with a fuel fed catalytic porous structure whereby the copper is deposited on said structure without the reduction of the arsenic and antimony in said copper-containing solution to arsine and stibine.

10 Claims, 1 Drawing Figure

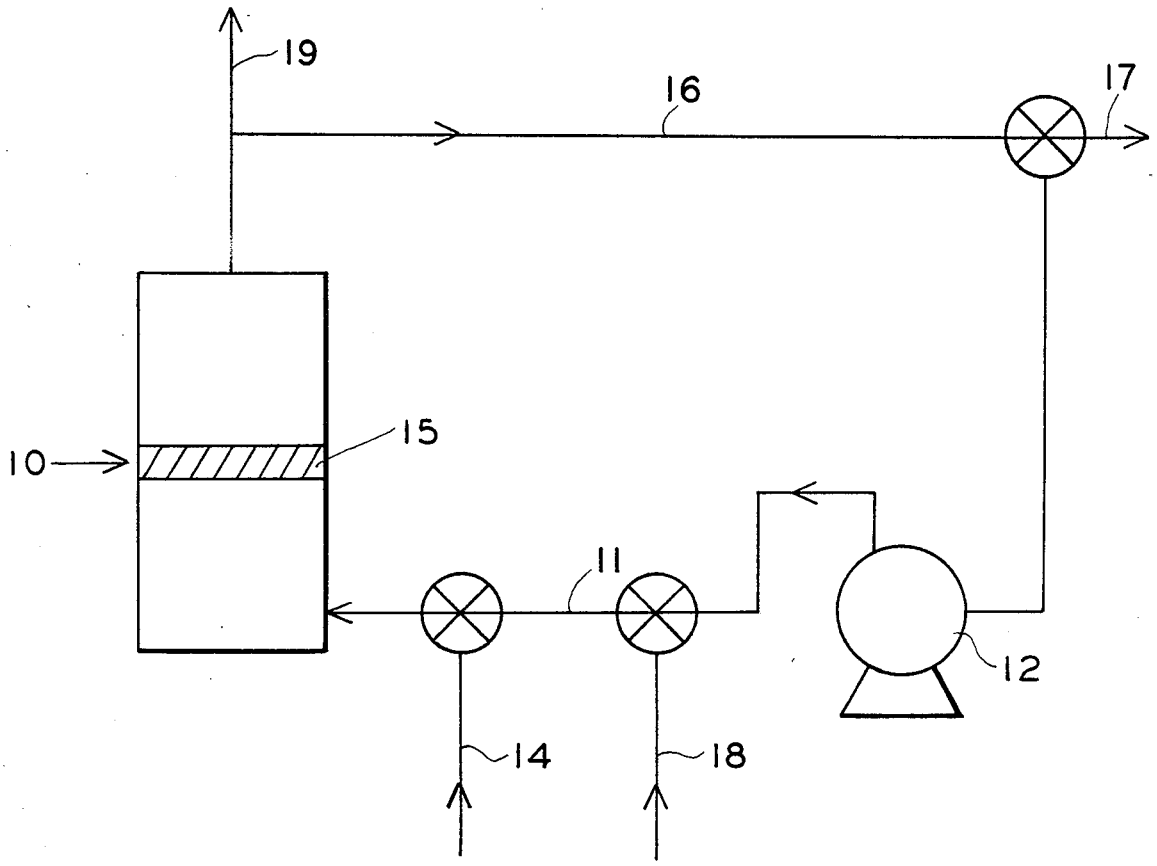
19
16
17
10
15
11
12
14
18

EFFICIENT, SAFE METHOD FOR DECOPPERING COPPER REFINERY ELECTROLYTE

FIELD OF THE INVENTION

The present invention relates to the decoppering of refinery electrolytes. More particularly, the invention is concerned with decoppering refinery electrolytes containing antimony and arsenic impurities so as to avoid the formation of stibine or arsine gas which would normally be formed under decoppering conditions.

BACKGROUND OF THE INVENTION

Electrorefining of impure anode copper to produce high purity copper cathode is a well known commercial process. As is known, in carrying out the electrorefining process, copper in the anode dissolves and reports at the cathode while insoluble impurities in the anode copper such as selenides, silver and precious metals during dissolution of the copper anode settle to the bottom of the electrorefining tank. Soluble impurities dissolve, of course, in the electrolyte, gradually building up in concentration. The most common soluble impurities are antimony, arsenic and nickel. Copper, however, also builds up in the electrolyte as a result of the dissolution of the copper oxide present in the anode copper. The copper oxide dissolves as is shown in Equation 1.

$$Cu_2O + H_2SO_4 \rightarrow CuSO_4 + Cu + H_2O \quad \text{(Eq. 1)}$$

To maintain a desirable copper concentration and reject impurities, a portion of the electrolyte employed in the electrorefining step is withdrawn and pumped to decopperizing cells or liberators. Indeed, these liberators typically consist of a number of cells to which the refinery electrolyte is passed in a cascaded series. In any event, the copper content of the solution passing through the liberators ultimately is depleted to such significantly low levels that the deposition potential of the copper becomes increasingly more positive resulting first in the generation of hydrogen within the cell and the concurrent deposition of the impurity metals, e.g., arsenic, antimony, bismuth and the like. Most importantly, however, the antimony and arsenic can thereafter be reduced to their respective hydrides, namely, arsine and stibine, which are extremely toxic gases, the evolution of which must be avoided.

A number of techniques have been disclosed for avoiding the evolution of arsine and stibine during operation of the liberator cells. For example, in U.S. Pat. No. 4,115,512, a method is described for removing arsenic from refinery electrolyte by solvent extraction. In U.S. Pat. No. 4,083,761, the application of periodic reverse current during operation of a liberator cell is disclosed as a technique for inhibiting arsine formation.

Now it has been discovered that in electrorefining processes, after partial decopperization of the electrorefining electrolyte, further decopperization of the electrolyte can be achieved by use of a fuel fed porous catalytic anode whereby the formation of toxic gases, such as arsine and stibine, are avoided.

SUMMARY OF THE INVENTION

Briefly stated, the present invention is directed toward a method for removing copper from solutions containing arsenic and antimony and in which the copper concentration in the solution is sufficiently low whereby arsine and stibine would normally be generated if the solution was subject to electrolysis. According to the practice of the present invention, copper is recovered from such solutions by contacting said solutions with a fuel fed catalytic porous structure whereby the copper is deposited on said structure without the reduction of the arsenic and antimony in said copper-containing solution to arsine and stibine.

The invention summarized hereinabove including all the embodiments stemming therefrom will become readily apparent upon reading the detailed description which follows.

BRIEF DESCRIPTION OF THE DRAWING

The accompanying FIGURE is a schematic representation of a cell useful in the practice of the present invention.

DETAILED DESCRIPTION OF THE INVENTION

In the description which follows, reference will be made particularly to the preferred application of the recovery of copper in accordance with the present invention; however, it should be readily appreciated that the invention has wider applicability.

In any event, taking a typical copper electrorefining process as an example, copper containing electrolyte from the electrorefining cell is pumped in cascaded fashion through a multiplicity of liberator cells where the electrolyte is electrolyzed to recover the copper therein. Using a three stage cascade as an example, the electrolyte introduced into Stage 1 would contain, in general, from about 40 to 50 grams per liter copper and 170 to 185 grams per liter of sulfuric acid. The electrolyte removed from Stage 1 and introduced into Stage 2 will typically have from 20 to 30 grams per liter of copper and from 200 to 215 grams per liter of sulfuric acid. Finally, the electrolyte removed from Stage 2 and introduced into Stage 3 will have generally low levels of copper, for example, in th range from about 5 to 15 grams per liter of copper and from about 225 to 240 grams per liter of sulfuric acid. Additionally, the arsenic concentration in the electrolyte being introduced into Stage 3 can extend from as low as about 1 gram per liter to about 25 grams per liter. The antimony concentration will be about 0.6 grams per liter of solution. It is important to note that while the electrolyte being introduced into Stage 3 of the decopperizing process has a copper concentration of from about 5 to 15 grams per liter, the actual concentration of copper in the electrolyte in the liberator, and especially in the vicinity of the electrode, is so low that if the normal current density is applied to such an electrolyte, hydrogen would be generated and ultimately the arsenic and antimony present in the electrolyte would be reduced to volatile hydrides.

In accordance with the practice of the present invention, however, an electrolyte solution containing a sufficiently low copper concentration, for example, below about 5 grams per liter of copper and including arsenic and antimony whereby arsine and stibine would be generated if subjected to electrolysis, is decopperized by means of a porous fuel fed, for example, hydrogen fed, catalytic structure. Simply, the solution is placed in contact with an electrically conductive porous substrate having a fuel, e.g., hydrogen, activating catalyst while simultaneously supplying a fuel to the substrate. In this way, the deposition of copper will occur without the generation of arsine and stibine. The reason toxic gases are not generated should be apparent when one considers that the reactions which generate toxid hydrides of antimony and arsenic require an EMF of −0.6 volts at the normal acidity of liberation of about 200 to 250 grams per liter of sulfuric acid. Since the EMF of a hydrogen fed catalytic electrode cannot fall below an EMF of 0, arsine and stibine will not be generated and the fuel fed catalytic structure can be operated in an unregulated fashion while still achieving the objectives of safe copper, arsenic and antimony removal.

One type of fuel fed catalytic structure that may be employed in the practice of the present invention is a porous catalytic anode such as that used in fuel cells. In this respect, reference is made to the fuel cell electrodes described in, for example, U.S. Pat. No. 2,860,175 and U.S. Pat. No. 2,384,463. A preferred type of catalytic porous electrically conductive substrate that can be employed is the structure as disclosed in U.S. Pat. No. 4,385,970 which patent is incorporated herein by reference. Basically, that structure includes a porous electrically conductive substrate having a first surface for contact with a fuel and a second surface for contact with an acidic copper solution. The substrate has a fuel activating metal catalyst solely on the first surface. Additionally, the porosity of the first surface is such that under conditions for use, the current density is sufficiently high to deplete the metal ions near the second surface so that the metal is deposited on the second surface and not deposited within the pores of the substrate. Another type of porous structure which is particularly preferred for use as a fuel fed catalytic structure in the practice of the present invention is shown as structure 15 in the accompanying drawing. Basically, this structure includes an electrically conductive substrate which is sufficiently porous so that electrolyte and hydrogen can flow through the structure. The substrate, of course, is provided with a fuel activating catalyst on the surface thereof.

Catalysts for such structures include hydrogen activating catalysts such as the metals of Group VIII of the Periodic Table, e.g., rhodium, platinum and iridium.

Referring again to the accompanying drawing, a copper containing solution having low levels of copper, for example, in the range of from about 1 to about 5 grams per liter is introduced into cell 10 via line 11 by means of pump 12. The solution which is mixed with hydrogen introduced via line 14 flows through the catalytic fuel fed structure 15 with the result that copper is spontaneously deposited on the substrate without the evolution of arsine or stibine. Line 16 is provided for recirculation of the solution to cell 10. Optionally, copper depleted solution can be removed via line 17 and fresh copper containing solution can be introduced, for example, via line 18 from a preceeding liberator, for instance. As is shown, a line 19 is provided for the venting or recovery of unreacted hydrogen.

Thus, in a particularly preferred embodiment of the present invention, copper is won from acidic electrorefining solutions thereof by passing the copper solutions through at least one liberator cell, and optionally a series of liberator cells, whereby copper is electrodeposited on the cathode of the cell or cells and an acidic solution containing arsenic and antimony is obtained which also includes copper at concentrations sufficiently low so that arsine and stibine would be generated if the solution was subjected to electrolysis. Instead, the acidic solution obtained from the electrorefining step is passed in contact with a fuel fed porous catalytic structure while a fuel such as hydrogen is passed in contact with the structure whereby copper is deposited on the structure without the formation of arsine and stibine. The copper is recovered and may be sent, for example, to the anode furnace. Additionally, antimony and arsenic may subsequently be removed from the solution by hydrogen cementation or other techniques known in the art.

In order that those skilled in the art may more readily understand the present invention, the following example is provided.

EXAMPLE

A cell, like cell 10 of the drawing, was provided with a fuel fed porous catalytic structure 15. The catalytic structure was prepared by slurrying 7 parts of platinum supported carbon powder and 3 parts of polytetrafluoroethylene in distilled water. The mixture was then coagulated with aluminum sulfate and suction filtered. Thereafter, the filter cake was transferred to a carbon cloth, cold pressed and then hot pressed at 320° C. for two minutes to sinter the polymer and bond it with the carbon supported catalyst to the cloth. Thereafter, a metal mesh support was attached to the cloth using a carbon filled epoxy cement.

A copper solution was prepared having the following composition:

5 g/c Cu
185 g/l $H_2SO_4$
5 g/l As ($\frac{1}{2}$ as $As^{+3}$ and $\frac{1}{2}$ as $As^{+5}$)
0.5 g/l $Fe^{+3}$
0.5 g/l $Sb^{+3}$
30 mg/l $Cl^-$
15 g/l Ni The solution along with gaseous hydrogen was passed in two phase flow through the cloth until the Cu concentration in the solution was less than 1 ppm. A new catalyzed cloth was then substituted and the solution and hydrogen were passed through the new cloth. Copper was cemented on the new cloth without the evolution of arsine or stibine. Indeed, analysis showed that the copper deposits cemented on the second cloth had the following composition.

Cu:96.88%
As:2.96
Ni:0.02
Sb:0.14

The nickel contamination is probably from entrainment. In any event, the copper was recovered without evolution of arsine and stibine.

It should be appreciated that wide latitude in modification and substitution is intended in the foregoing disclosure. Accordingly, it is appropriate that the appended claims be construed broadly in a manner consistent with the spirit and scope of the invention described herein.

What is claimed is:

1. In the process of electrowinning copper from copper electrorefining electrolyte solutions containing arsenic and antimony wherein the copper concentration is sufficiently low that during electrolysis of such solutions toxic arsine and stibine gas would be formed at the cathode, the improvement comprising:

passing said copper solution and a fuel in contact with a fuel fed porous electrically conductive catalytic structure whereby copper is deposited on said structure without the evolution of arsine or stibine.

2. The improvement of claim 1 wherein said copper solution contains about 1 to 5 grams/liter copper.

3. The improvement of claim 2 wherein said fuel is fed to a first side of said porous structure and said copper solution is in contact with a second side of said porous structure.

4. The improvement of claim 2 wherein said fuel and said copper solution are simultaneously passed through said porous catalytic structure.

5. The improvement of claim 3 or 4 wherein said fuel is hydrogen.

6. In a copper electrorefining process wherein electrorefining electrolyte containing arsenic and antimony is transferred to at least one liberator cell for copper recovery, the improvement comprising: electrolyzing said electrolyte to produce a solution containing from about 1 to about 5 grams/liter of copper and thereafter passing said solution and a fuel in contact with a fuel fed porous catalytic structure whereby copper is deposited on said structure without the liberation of arsine or stibine.

7. The improvement of claim 6 wherein said copper solution and fuel are passed simultaneously through said porous catalytic structure.

8. The improvement of claim 7 wherein said fuel is hydrogen.

9. The improvement of claim 6 wherein said catalytic structure has a first side and a second side, and said copper containing solution is placed in contact with said first side, and wherein said fuel is hydrogen and said fuel is placed in contact with said second side.

10. A process for electrowinning copper from aqueous acidic solutions thereof which contain arsenic and antimony, comprising:

introducing said solution into an electrolytic cell having an anode and cathode;

passing an electric current through said cell whereby copper is deposited on said cathode;

removing said solution from said electrolytic cell when said copper in said solution is in the range of from about 1 to 5 grams/liter;

thereafter placing hydrogen and said removed copper solution in contact with an electrically conductive porous catalytic structure whereby copper is spontaneously deposited on said structure without the evolution of arsine or stibine.

* * * * *